US006612804B2

(12) United States Patent
Su

(10) Patent No.: US 6,612,804 B2
(45) Date of Patent: Sep. 2, 2003

(54) SWIRLING COMPRESSOR

(76) Inventor: Huo-Chen Su, No. 452, Dong Keng Rd., Dong Shi Chen, Taichung Hsien (TW)

( * ) Notice: Subject to any disclaimer, the term of this patent is extended or adjusted under 35 U.S.C. 154(b) by 38 days.

(21) Appl. No.: 10/057,905

(22) Filed: Jan. 29, 2002

(65) Prior Publication Data

US 2003/0143076 A1 Jul. 31, 2003

(51) Int. Cl.[7] ..... F01D 5/00

(52) U.S. Cl. ..... 415/73; 416/176

(58) Field of Search ..... 416/176, 177, 416/4, 90 R, 91, 227 R; 415/72, 73, 202

(56) References Cited

U.S. PATENT DOCUMENTS 773,316 A * 10/1904 Evans ..... 417/94
1,046,490 A * 12/1912 Porter ..... 60/669

* cited by examiner

*Primary Examiner*—Edward K. Look
*Assistant Examiner*—Dwayne J. White
(74) *Attorney, Agent, or Firm*—Rosenberg, Klein & Lee

(57) ABSTRACT

A swirling compressor comprises a number of swirling tubes and a motor, each swirling tube has a fixture at a center portion with a flange bulging out from one side and a hole at the other end of the center portion opposing the flange, an aperture is formed close to the center end at the inside of the tube, this fixture design allows the swirling tube to pile up with one over the other forming a wind passage, and a spindle of a motor is inserted through the hole and secured thereat. When the motor driven the swirling tubes set to spin, each tube collects a portion of whirlwind, and all whirlwind will be blown out from the fixture.

3 Claims, 5 Drawing Sheets

SWIRLING COMPRESSOR

BACKGROUND OF THE INVENTION

1. Field of the Invention

This invention relates to a swirling compressor, in particular to a compressor with more than one swirling tube to produce a stronger whirlwind.

2. Description of the Related Prior Art

A conventional compressor, as shown in FIG. 5, uses a motor to drive a fan A and blow the wind out from an outlet of a compressor B. This design uses the fan A to suck air, thus the air volume depends on the output power of the motor and the size of the fan. Although this design can produce a large amount of wind, however due to lack of collecting consideration, only 60 percent wind were send to the outlet, while the rest 40 percent wind were dismissed in the air, thus the conventional compressor has a low wind output.

In view of this and many other shortcomings, the inventor has derived this design, which corrects all of the above-mentioned shortcomings.

SUMMARY OF THE INVENTION

It is the primary object of the present invention to provide a swirling compressor, which produces a stronger whirlwind than a conventional compressor.

It is another object of the present invention to provide a swirling compressor, which structure is stronger and lasts longer.

It is a further object of the present invention to provide a swirling compressor, which is inexpensive in production.

DETAILED DESCRIPTION OF THE PREFERRED EMBODIMENT

Figure 1:
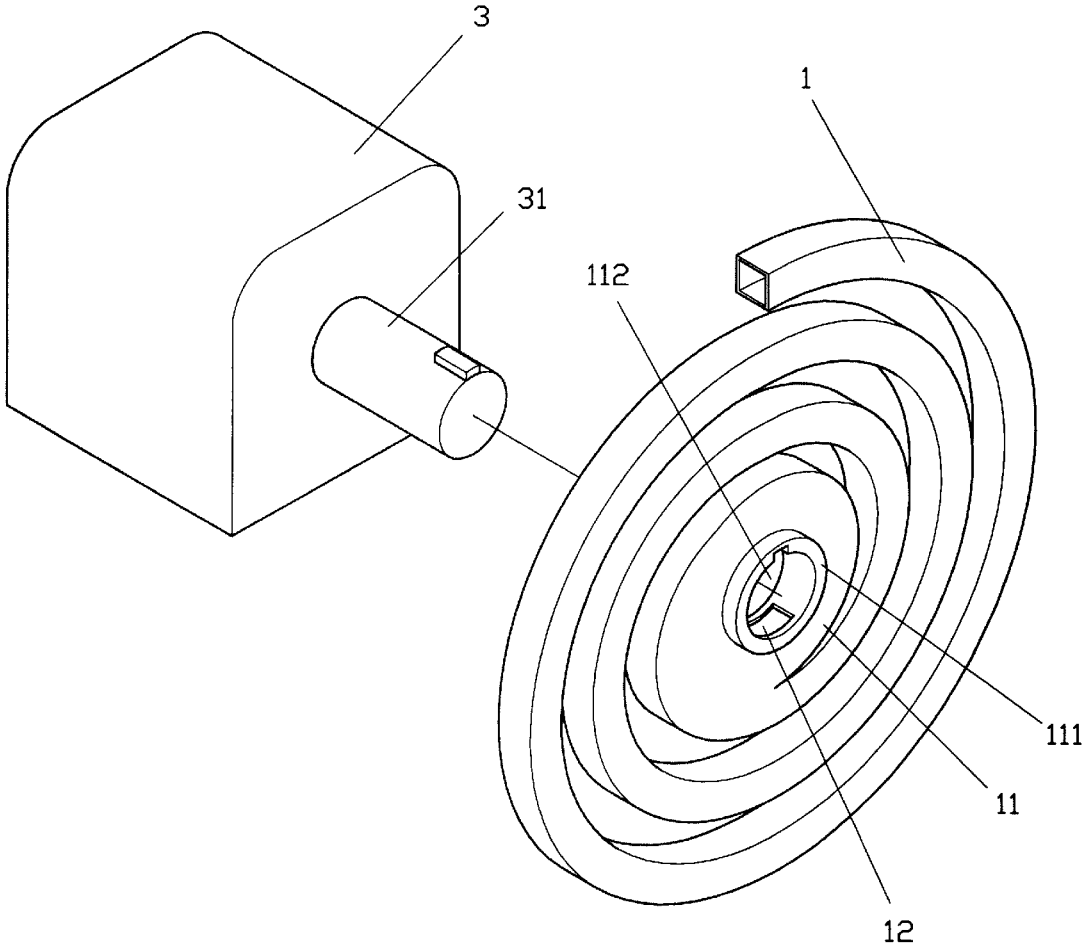
FIG. 1 is a perspective view of a structure of the present invention.
Figure 2:
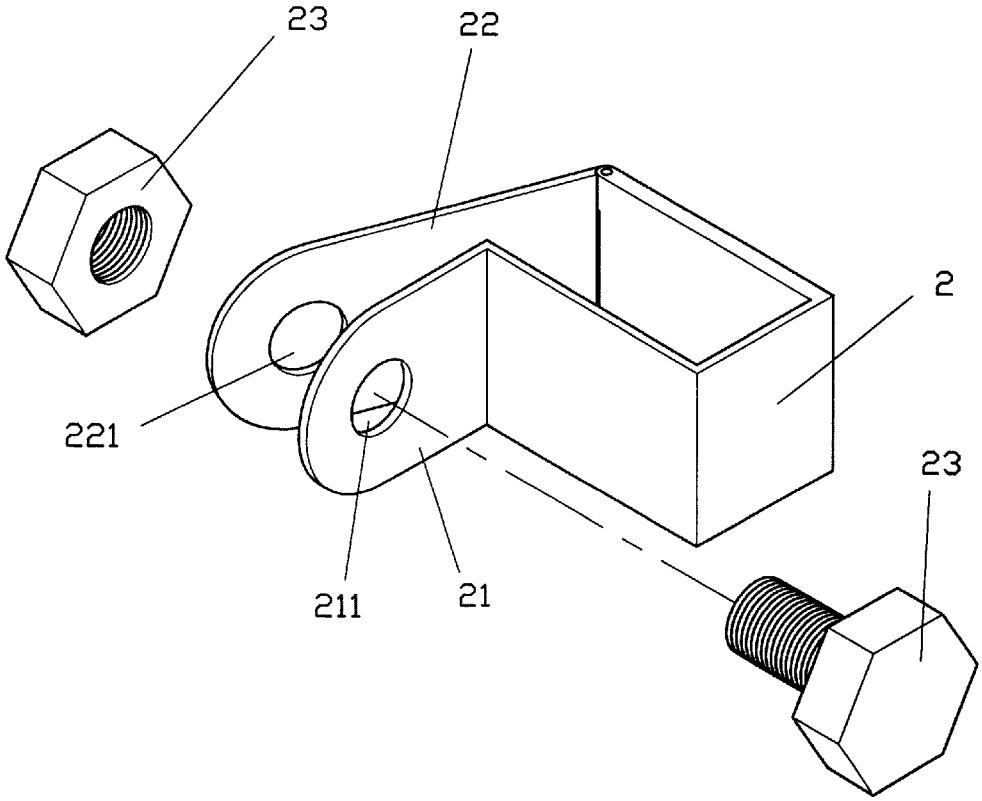
FIG. 2 is a perspective view of a fixture of the present invention.
Figure 3:
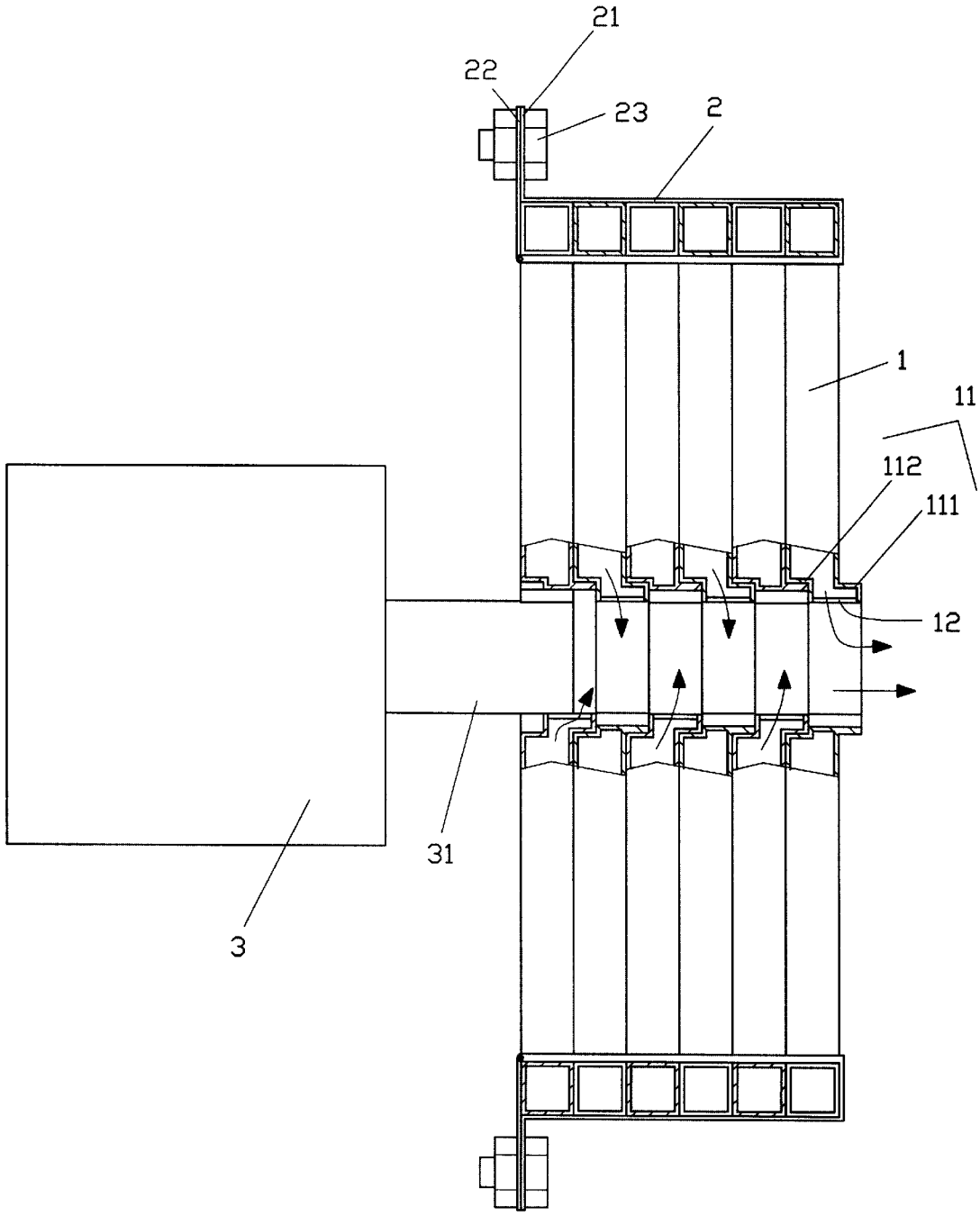
FIG. 3 is a side view of the present invention, partially sectioned.
Figure 4:
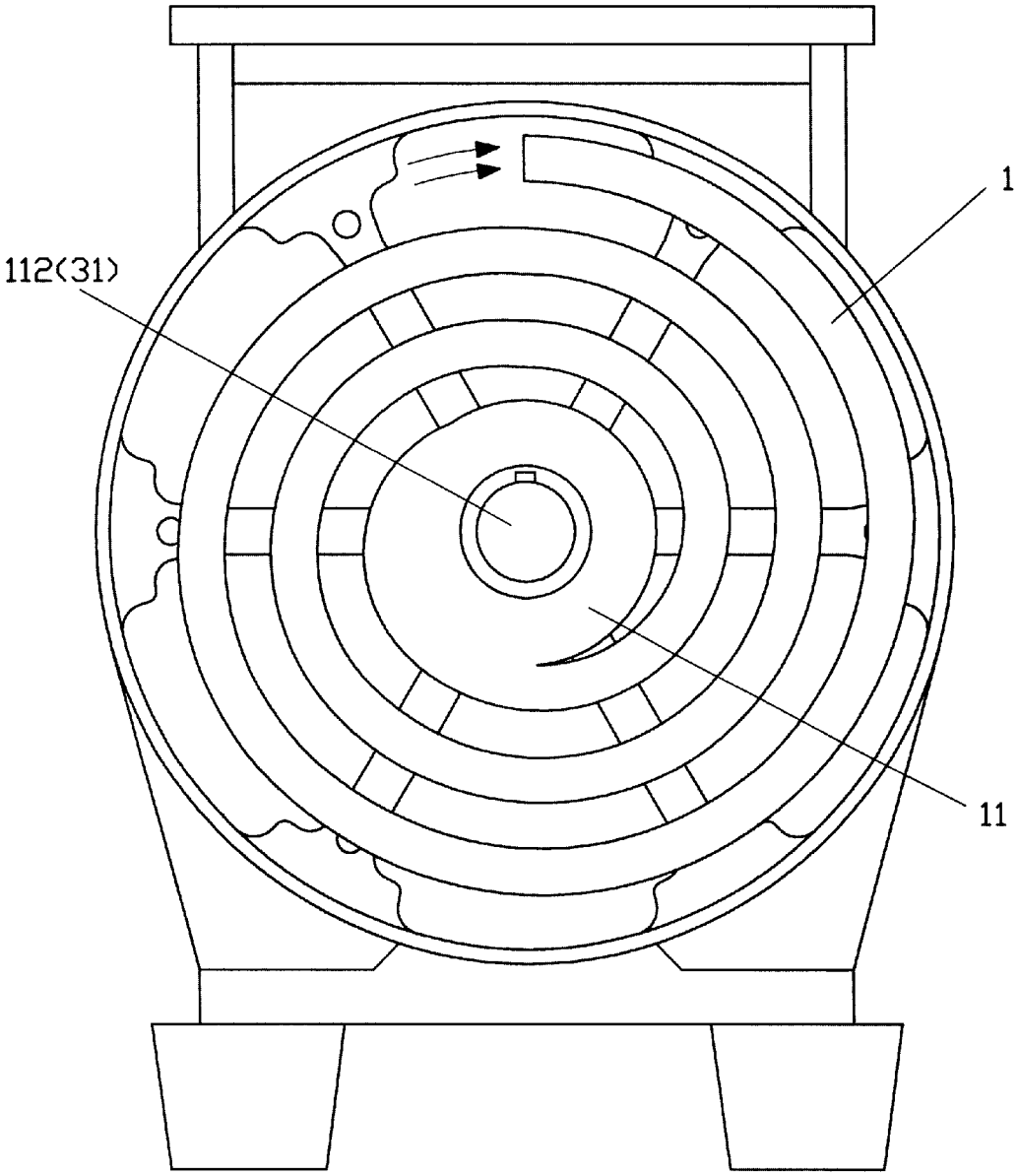
FIG. 4 is a front view of the present invention.
Figure 5:
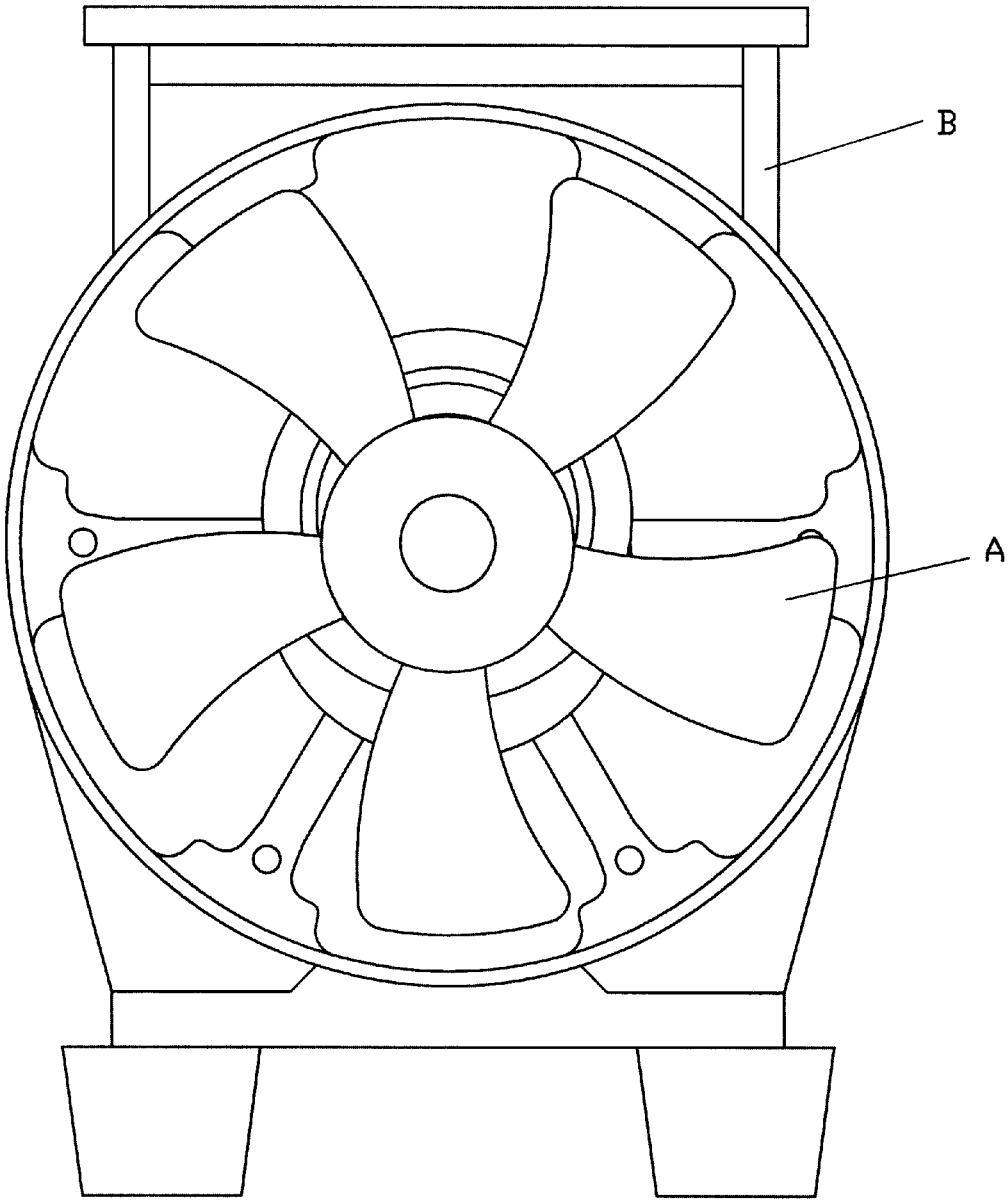
FIG. 5 PRIOR ART
FIG. 5 is a front structural view of a prior art.

A swirling compressor of the present invention, as shown in FIG. 1, comprises a number of swirling tubes 1 and clips 2, and a motor 3.

Each of the swirling tubes 1 has a fixture 11 at the center portion, the fixture 11 has one side at its center bulging out to form a flange 111, whereas the other side of the fixture 11 has a recess forming a hole 112, and the swirling tube 1 is formed by extending its body from the fixture 11 in a spiral shape, and has an aperture 12 at the inner edge.

The clip 2 is a frame, which is able to secure the swirling tube 1, and is composed of an opening with one of its opening ends formed as a loose end 21 having a hole 211 at its center portion, the other opening end of the clip 2 has a fixed end 22 with a hole 221 at its center portion thereof. Upon the clip 2 secures the swirling tubes 1, the two holes 211 and 221 are secured by a fastener 23 to secure the swirling tubes 1 at place.

To assemble the present invention, pile up all swirling tubes 1 with the opening end of each swirling tube 1 in a 180 degrees away from each other, and with the flange 111 of each swirling tube 1 inserted into the hole 112 of the next swirling tube 1, and then secured by the clip 2 on every two (or three) swirling tubes 1. Insert and secure a spindle 31 of the motor 3 through the holes 112 of the swirling tubes 1, thus when the motor 3 is activated, the spindle 31 shall drive the swirling tubes 1 to spin as well.

When activation, the motor 3 drives all swirling tubes 1 to spin, simultaneously, whirlwind is formed in each swirling tube 1 at this moment and blows out from its aperture 12 of the fixture 11, therefore, the more swirling tubes 1 are adapted, the larger volume of whirlwind can made.

This design is to maintain the swirling tubes 1 to spin through the driving force of the motor 3, the spinning of the swirling tubes 1 squeezes the wind in each tube towards the end and the wind is finally blown out from each aperture 12. All of the whirlwind blown out from their apertures 12 will then blown out through the fixture 11.

I claim:

1. A swirling compressor comprising a number of swirling tubes and a motor, wherein each said swirling tube having a fixture with a hole at center portion thereof, said fixture comprising a flange bulging out from one side and a hole at the other side opposing said flange, and an aperture at an inner wall interconnected with inside of said swirling tube, said flange and said hole of said swirling tube allowing said swirling tube to pile up with each other, thus forming multiple swirling tubes, which produce a whirlwind said whirlwind being collected and blown out through said aperture and then through said fixture.

2. The swirling compressor, as recited in claim 1, wherein said swirling tubes are secured by clips to form an integral structure.

3. The swirling compressor, as recited in claim 1, wherein each said swirling tube has its opening maintained in 180 degrees with each other.

* * * * *